US011167332B2

(12) United States Patent
Weinzierl

(10) Patent No.: US 11,167,332 B2
(45) Date of Patent: Nov. 9, 2021

(54) COOLING SECTION WITH COOLANT FLOWS WHICH CAN BE ADJUSTED USING PUMPS

(71) Applicant: Primetals Technologies Germany GmbH, Erlangen (DE)

(72) Inventor: Klaus Weinzierl, Nuremberg (DE)

(73) Assignee: PRIMETALS TECHNOLOGIES GERMANY GMBH, Erlangen (DE)

( * ) Notice: Subject to any disclaimer, the term of this patent is extended or adjusted under 35 U.S.C. 154(b) by 0 days.

(21) Appl. No.: 17/261,080

(22) PCT Filed: Jul. 23, 2019

(86) PCT No.: PCT/EP2019/069763
§ 371 (c)(1),
(2) Date: Jan. 18, 2021

(87) PCT Pub. No.: WO2020/020868
PCT Pub. Date: Jan. 30, 2020

(65) Prior Publication Data

US 2021/0245215 A1 Aug. 12, 2021

(30) Foreign Application Priority Data

Jul. 25, 2018 (EP) ..... 18185526

(51) Int. Cl.
*B21B 37/76* (2006.01)
*B21B 45/02* (2006.01)

(52) U.S. Cl.
CPC ..... *B21B 37/76* (2013.01); *B21B 45/0218* (2013.01)

(58) Field of Classification Search
CPC ..... B21B 45/0215; B21B 45/0218; B21B 45/0233; C21D 1/667
(Continued)

(56) References Cited

U.S. PATENT DOCUMENTS 4,596,615 A * 6/1986 Matsuzaki ..... B21B 37/44 148/503
2007/0074846 A1* 4/2007 Sommerhofer .... B22D 11/1241 164/486

(Continued)

FOREIGN PATENT DOCUMENTS

EP 2767353 A1 8/2014
EP 2898963 A1 7/2015
WO 2010040614 A2 4/2010

OTHER PUBLICATIONS

International Search Report and Written Opinion received in International Application No. PCT/EP2019/069763 dated Sep. 17, 2019, pp. 14.

(Continued)

*Primary Examiner* — Gregory D Swiatocha
*Assistant Examiner* — Bobby Yeonjin Kim
(74) *Attorney, Agent, or Firm* — Liang & Hennessey LLP; Brian Hennessey

(57) ABSTRACT

A cooling section arranged within, upstream of, or downstream of a rolling train is provided. A hot-rolled product made of metal is cooled by the cooling section. Application devices of the cooling section are supplied with an actual current of a water-based liquid coolant via a supply line and a pump. The actual current of the coolant is applied to the hot-rolled product by means of the application device. The hot-rolled product is transported within the cooling section in a horizontal transport direction during the application of the coolant. A controller of the cooling section dynamically ascertains a target actuation state for each pump on the basis of a target current of the coolant to be applied onto the hot-rolled product by the application device and controls the
(Continued)

pump in a corresponding manner such that the actual current delivered by each pump approximates the target current as much as possible.

16 Claims, 5 Drawing Sheets

(58) Field of Classification Search
USPC ..... 72/201
See application file for complete search history.

(56) References Cited

U.S. PATENT DOCUMENTS

2008/0035298 A1* 2/2008 Yu ..... B22D 11/1213 164/455
2009/0314460 A1* 12/2009 Sommerhofer .... B22D 11/0682 164/485
2010/0218516 A1* 9/2010 Nemer ..... F27B 9/12 62/64
2012/0298224 A1* 11/2012 Imanari ..... B21B 37/74 137/551
2014/0030113 A1* 1/2014 Pines ..... F04B 47/06 417/53
2014/0044560 A1* 2/2014 Komatsu ..... F04D 15/0088 417/19
2015/0375284 A1* 12/2015 Chen ..... B21B 45/0215 72/201
2016/0052033 A1* 2/2016 Chen ..... B21B 43/00 72/201
2017/0350400 A1* 12/2017 Lockwood ..... B08B 15/02

OTHER PUBLICATIONS

European Search Report received in European Application No. EP18185526.3 dated Jan. 11, 2019, pp. 6.

* cited by examiner

COOLING SECTION WITH COOLANT FLOWS WHICH CAN BE ADJUSTED USING PUMPS

CROSS-REFERENCE TO RELATED APPLICATIONS

The present application is a national phase application of PCT Application No. PCT/EP2019/069763, filed Jul. 23, 2019, entitled "COOLING SECTION WITH COOLANT FLOWS WHICH CAN BE ADJUSTED USING PUMPS", which claims the benefit of European Patent Application No. 18185526.3, filed Jul. 25, 2018, each of which is incorporated by reference in its entirety.

BACKGROUND OF THE INVENTION

1. Field of the Invention

The present invention relates to a cooling section arranged within a rolling train or upstream or downstream of the rolling train and by means of which a hot-rolled product made of metal is cooled, and an operating method for a cooling section.

2. Description of the Related Art

In the cooling section of a rolling mill, a metal rolled product is cooled after rolling. The rolled product can be made of steel or aluminum, for example. Depending on requirements, this can be a flat rolled product (strip or plate), a rolled product in the form of rods, or a profile. Precise temperature management in the cooling section is customary in order to establish desired material properties and to keep said properties constant with less scatter. Particularly in the case of a cooling section arranged downstream of the rolling train, a plurality of spray bars is installed for this purpose along the cooling section, by means of which bars a liquid coolant, usually water, is applied to the rolled product from above and from below in order to cool the hot-rolled product. It should be possible to adjust the quantity of water flowing through the respective spray bar as quickly as possible and as precisely as possible.

To adjust the quantities of water supplied to the spray bar, there is a known practice, for example, of arranging on-off valves or control valves in the supply lines. On-off valves can only be controlled in a purely binary way. They are either fully open or fully closed. Control valves can be continuously adjusted, and it is therefore also possible to continuously adjust the quantity of water supplied to the respective spray bar.

In the case of control valves, the valves can be designed as control flaps or as ball valves. Control flaps are relatively simple and inexpensive. However, they can be operated only with relatively small pressure differences, generally no more than 1 bar. Otherwise, cavitation phenomena occur, very quickly damaging the control flap. Control flaps are therefore not suitable, particularly for intensive cooling. However, they are often disadvantageous even in a laminar cooling section. In particular, they often exhibit a switching hysteresis. The switching hysteresis has the effect that the flap angle set is different for the same actuation, depending on whether the control flap is adjusted from a more fully open or more fully closed position to the new position to be adopted. Ball valves do not have a flap but have a ball with a hole in it, which is rotated in a pipe. Depending on the rotational position of the ball, a larger or smaller cross section is made available for the coolant to flow through. Ball valves can be operated with higher pressure differences of up to about 3 bar. With these valves, hysteresis does not occur or is negligibly small. However, ball valves are expensive.

In another solution, the coolant is supplied continuously to the spray bars. However, there is a controllable deflection plate. Depending on the position of the deflection plate, the coolant is either supplied to the rolled product or flows off at the side without contributing to the cooling of the rolled product. In this arrangement, rapid switching processes without pressure surges are possible. Continuous adjustment of the quantity of water is not possible, however. Moreover, the full coolant flow must be delivered continuously.

All types of valves and also the deflection plates require corresponding actuators. Pneumatically driven servomotors are conventional. A position control system is additionally required for control valves. This continuously compares the actual position of the respective control valve with the target position thereof and adjusts the actual position until there is sufficient agreement with the target position.

Common to all the arrangements is furthermore the fact that there must be an external coolant supply. The coolant can be taken from a gravity tank, for example, or can be transported in via a relatively large pipeline from a remote pumping station. Combinations of these approaches are also possible. In the case of "intensive cooling", for example, water is often initially taken from a gravity tank. The pressure is then increased to a variable extent by means of booster pumps and thereby made available with a correspondingly variable pressure for intensive cooling. Usually, there are several booster pumps but they are not all connected in parallel, that is to say that they all take the cooling fluid from the same reservoir on the inlet side and supply it to a common collecting point on the outlet side. The intensive cooling system is provided with a plurality of spray bars, to which—starting from the booster pumps or the common collecting point—the coolant is supplied individually via a respective supply line. Arranged in the supply lines are ball valves, which are actuated to adjust the quantity of coolant supplied to the respective spray bar.

Various disadvantages arise in the prior art.

In the case of on-off valves, there are pressure shocks when switching off. It is therefore not possible to switch off on-off valves as quickly as might be desired. Normal switching times are above 1 second, and sometimes up to 2 seconds.

With control flaps and ball valves, similar control times are achieved. Moreover, a position control system is required for each control valve. The achievable accuracy is about 1% to 2%.

In the case of control valves too, there are pressure shocks when switching off. It is therefore not possible to switch off control valves as quickly as might be desired either. Normal switching times are in the region of about 1 second.

With all valves, there are flow losses, which lead to increased wear and also to increased energy consumption.

The pneumatic actuating drives are susceptible to defects. In particular, they suffer when subjected to frequent actuating processes. Moreover, they require additional energy for the control air, which must furthermore be cleaned and dried and, for example, made available by a dedicated compressor.

WO 2010/040 614 A2 discloses a descaling device in which a pump is driven by means of a variable-speed drive. An operating state of the descaling region and a degree of filling of a high-pressure accumulator are taken into account in the control of the drive.

US 2008/0 035 298 A1 discloses a casting process in which use is made, inter alia, of a cooling water source that comprises a water-cooled coil. The cooling water is supplied to the coil by means of a pump, which can be switched on and off and has a mechanism for controlling the quantity of coolant. There is recirculation of the liquid. The temperature of the cast metal strand is detected and fed to a controller. The controller controls the cooling water source on this basis.

US 2010/0 218 516 A1 discloses a method in which a metal strip is cooled by means of a liquid cooling medium in a cooling device in the context of a heat treatment of the metal strip. The metal strip runs vertically from the bottom up. The cooling medium is pentane or a mixture of pentane and hexane. During the application of the cooling medium, the metal strip is in an inert gas atmosphere. Depending on the temperature of the metal strip on the inlet side and the outlet side of the cooling device and on the speed of the metal strip, a quantity of coolant that should be fed by a pump to the application devices of the cooling device is determined. The pump is controlled in accordance with the result.

US 2007/0 074 846 A1 discloses a casting process in which the cast strand is passed through a cooling chamber in which the cast strand is cooled by means of a liquid cooling medium. The liquid cooling medium is a metal or a molten salt. The liquid cooling medium is taken from a reservoir by means of a circulating pump, supplied to the cooling chamber and then fed back to the reservoir from the cooling chamber. The quantity of liquid is controlled on the basis of the temperatures at which the liquid cooling medium is supplied to the cooling chamber or discharged from the cooling chamber and on the basis of the pressure on the inlet side of the cooling chamber.

US 2009/0 314 460 A1 discloses a casting process in which the cast strand is formed by means of a twin-roll caster. The rolls are internally cooled by means of a liquid cooling medium. The liquid cooling medium is a metal or a molten salt. The liquid cooling medium is taken from a reservoir by means of a circulating pump, supplied to the rolls and then fed back to the reservoir from the cooling chamber.

US 2012/0 298 224 A1 discloses the predictive operation of a pump in the context of a rolling mill with a downstream cooling section. However, this pump does not directly feed the application devices by means of which the cooling medium is applied to the hot-rolled product but delivers the cooling medium only into a reservoir so that the latter is always adequately filled. The application of the coolant to the rolled product itself is not explained specifically.

EP 2 898 963 A1 discloses a cooling section which is arranged downstream of a rolling train and by means of which a hot-rolled product made of metal is cooled. In this cooling section, there is a number of application devices, which are supplied with a respective actual flow of a water-based liquid coolant via a respective supply line. The respective actual flow of the coolant is applied to the hot-rolled product by means of the respective application device. The hot-rolled product is transported within the cooling section in a horizontal transport direction during the application of the coolant.

EP 2 767 353 A1 likewise discloses a cooling section which is arranged downstream of a rolling train and by means of which a hot-rolled product made of metal is cooled. In this cooling section, there is a number of application devices, which are supplied with a respective actual flow of a water-based liquid coolant via a respective supply line. The respective actual flow of the coolant is applied to the hot-rolled product by means of the respective application device. The hot-rolled product is transported within the cooling section in a horizontal transport direction during the application of the coolant. Arranged in the supply lines are valves, the opening positions of which are adjusted dynamically by a controller of the cooling section. A common pump arranged upstream of the supply lines is adjusted by the controller in accordance with a total flow to be applied to the rolled product by means of the application device as a whole.

SUMMARY OF THE INVENTION

It is the object of the present invention to create possibilities by means of which a cooling section with superior operating characteristics is achieved in a simple and reliable manner.

The object is achieved by means of an operating method having the features of the independent claim. Advantageous embodiments of the operating method form the subject matter of the dependent claims.

The present invention starts from an operating method for a cooling section arranged within a rolling train or upstream or downstream of the rolling train and by means of which a hot-rolled product made of metal is cooled, wherein a number of application devices of the cooling section is supplied with a respective actual flow of a water-based liquid coolant via a respective supply line and a respective pump, wherein the respective actual flow of the coolant is applied to the hot-rolled product by means of the respective application device, wherein the hot-rolled product is transported within the cooling section in a horizontal transport direction during the application of the coolant.

The present invention furthermore starts from a cooling section arranged within a rolling train or upstream or downstream of the rolling train and by means of which a hot-rolled product made of metal is cooled, wherein the cooling section has a number of application devices, which are supplied with a respective actual flow of a water-based liquid coolant via a respective supply line of the cooling section and a respective pump of the cooling section, wherein the respective actual flow of the coolant is applied to the hot-rolled product by means of the respective application device, wherein the hot-rolled product is transported in the cooling section in a horizontal transport direction during the application of the coolant.

According to the invention, an operating method of the type stated at the outset is configured in such a way that a controller of the cooling section dynamically determines a respective target control state for the respective pump on the basis of a respective target flow of the coolant to be applied to the hot-rolled product by means of the respective application device and controls the respective pump in a corresponding manner such that the respective actual flow delivered by the respective pump is approximated as far as possible to the respective target flow at any time.

The respective pump—to be more precise: the drive for the respective pump—is therefore a variable-speed drive. It can be controlled by a frequency converter, for example. In the context of dynamic control, only the respective pump is actuated, but not any valve that might be arranged in the respective supply line.

Open-loop or closed-loop control may be performed, depending on requirements. In the case of closed-loop control, the respective actual flow of the liquid coolant is detected on the inlet side or the outlet side of the respective pump and supplied to the controller.

In many cases, the rolled product is a flat rolled product, e.g. a strip or a plate. In this case, it is possible that the liquid coolant is applied to the rolled product from both sides by means of the respective application device. Alternatively, it is possible that the liquid coolant is applied to the rolled product only from one side, in particular from above or from below, by means of the respective application device. Of course, in this case too, application of the coolant to the other side of the flat rolled product is also possible, and therefore the flat rolled product can be cooled simultaneously from above and from below, for example. In this case, however, there is a need for two application devices, which are controlled separately and, in principle, are also operated independently of one another. In this case, the operating method according to the invention is therefore carried out as it were in duplicate. However, the control of both pumps can be performed in a unitary way by one and the same controller. In this case, the controller can also take account of reciprocal dependency relationships in the cooling, if required.

It is possible that the respective application device has a plurality of spray nozzles which are arranged in series when viewed in the transport direction of the rolled product. For example, groups of spray nozzles which can be supplied in a unitary way with coolant via the respective supply line and the respective supply line and the respective pump can be formed within a single spray bar, for example. It is also possible to form groups of spray nozzles which span a plurality of spray bars and are supplied in a unitary way with coolant via the respective supply line and the respective pump. This embodiment can be of advantage, in particular, in that fewer pumps are required than if each spray bar were supplied with coolant via a dedicated supply line and a dedicated pump.

In many cases, the respective application device has a plurality of spray nozzles which are arranged side-by-side when viewed transversely to the transport direction of the rolled product. This can be expedient especially in the case of a flat rolled product (strip or plate). In this case, the respective application device can extend over the full width of the rolled product or only over part of the width. In the latter case, a plurality of application devices is arranged side-by-side and supplied with coolant in each case via a dedicated supply line and a dedicated pump, wherein the pumps are controlled independently of one another.

It is possible that no shutoff device is arranged between the respective pump and the respective application device. Alternatively, it is possible that a shutoff device is arranged between the respective pump and the respective application device. In this case, however, the shutoff device is either held fully open on a continuous basis as the rolled product is transported through the cooling section or, both in the opening and in the closing direction, is actuated exclusively when a speed of the respective pump is below a minimum speed. In this case, the respective minimum speed is so low that only a very slight actual flow is delivered. It is also possible for the shutoff device to be purely manually actuable in order to enable the respective application device to be taken out of operation, e.g. for maintenance purposes.

It is furthermore possible for a respective return line to be assigned in parallel to the respective pump. In this case, the return line has a smaller cross section than the respective supply line. This makes it possible to use pumps in which a certain minimum flow of coolant must always be maintained by reason of the design. However, the minimum flow is considerably less than the respective maximum possible flow of coolant. If a quantity of coolant that is less than the respective minimum flow is to be applied to the rolled product in such a case, all that is required is to correspondingly open a valve arranged in the return line (bypass mode).

It is furthermore possible that the respective pump is operated as a generator or operated with a reversed direction of rotation whenever the respective target flow falls below a respective lower limit value. It is thereby possible to achieve even very small actual flows. Moreover, it is thereby possible to prevent an excessive actual flow through a non-self-locking pump in the case of a low target flow.

In a preferred embodiment, it is envisaged that a check valve or a swing check valve is arranged in the respective supply line between the respective pump and the respective application device. It is thereby possible to prevent the respective pump from running dry and thereby being damaged.

Provision is preferably made for an inlet-side pressure of the liquid coolant to be detected ahead of the respective pump and for the controller to take account of the detected inlet-side pressure in determining the respective target control state of the respective pump. It is thereby possible to perform more accurate determination of the respective target control state for the respective pump.

It is possible for an outlet-side pressure of the liquid coolant to be detected after the respective pump and for the controller to take account of the detected outlet-side pressure in determining the respective target control state of the respective pump. This leads to even more accurate determination of the respective target control state.

The controller preferably determines the respective target flow on the basis of a respective thermodynamic energy state of the rolled product pertaining immediately before the respective application device is reached. Particularly accurate temperature management can thereby be achieved. The thermodynamic energy state of the rolled product can be known to the controller, e.g. on the basis of a prior measurement. Alternatively, it is possible to carry out model-supported calculation of the respective thermodynamic energy state, starting from a known thermodynamic energy state.

In a cooling section, a large number of application devices are often arranged sequentially in succession. The associated actual flows of the coolant are thereby applied to the hot-rolled product sequentially in succession by means of the application device. In this case, the operating method according to the invention is preferably configured in that the controller determines the respective thermodynamic energy state of the rolled product from the thermodynamic energy state of the rolled product before the immediately preceding application device while additionally taking account of the target flow of the coolant or of the actual flow of the coolant which is to be applied or is applied to the hot-rolled product by means of the immediately preceding application device. The calculation of the thermodynamic energy states can thus take place sequentially in succession.

The object is furthermore achieved by means of a cooling section having the features of the independent claim. Advantageous embodiments of the cooling section form the subject matter of the dependent claims.

According to the invention, a cooling section of the type stated at the outset is configured in such a way that the controller is designed in such a way that it dynamically determines a respective target control state for the respective pump on the basis of a respective target flow of the coolant to be applied to the hot-rolled product by means of the respective application device and controls the respective pump in a corresponding manner such that the respective actual flow delivered by the respective pump is approximated as far as possible to the respective target flow at any time.

The advantageous embodiments of the cooling section correspond substantially to those of the operating method. The advantages that can thereby be achieved also correspond to the respectively corresponding embodiments of the operating method.

BRIEF DESCRIPTION OF THE DRAWINGS

The above-described properties, features and advantages of this invention and the manner in which these are achieved will become more clearly and distinctly comprehensible in conjunction with the following description of the illustrative embodiments, which are explained in greater detail in combination with the drawings. Here, in schematic illustration.

DETAILED DESCRIPTION

Figure 1:
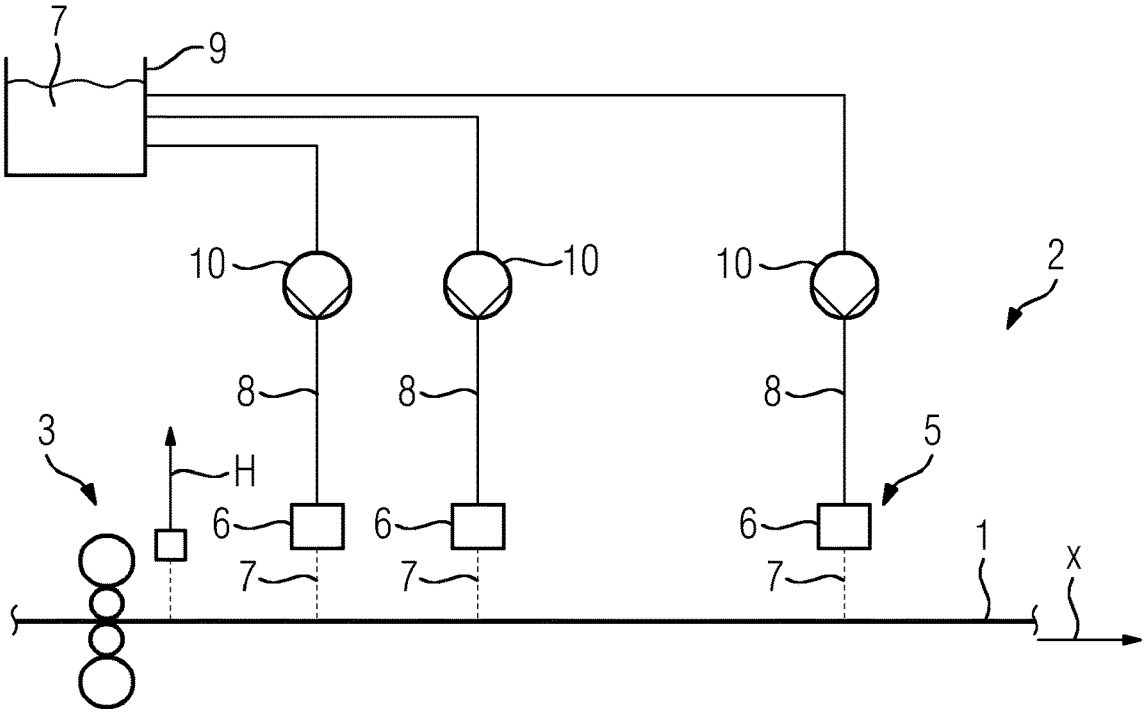
FIG. 1 shows a cooling section arranged downstream of a rolling train.

According to FIG. 1, a hot-rolled product 1 made of metal is to be cooled in a cooling section 2. According to FIG. 1, the cooling section 2 is arranged downstream of a rolling train. FIG. 1 illustrates just one rolling stand 3 of the rolling train, namely the last rolling stand 3 of the rolling train. In general, however, the rolling train has a plurality of rolling stands 3, through which the hot-rolled product 1 runs sequentially in succession. In the case of the embodiment shown in FIG. 1, the hot-rolled product 1 enters the cooling section 2 immediately after passing through the last rolling stand 3 of the rolling train. A time interval between rolling in the last rolling stand 3 of the rolling train and entry to the cooling section 2 is in the region of a few seconds.

Figure 2:
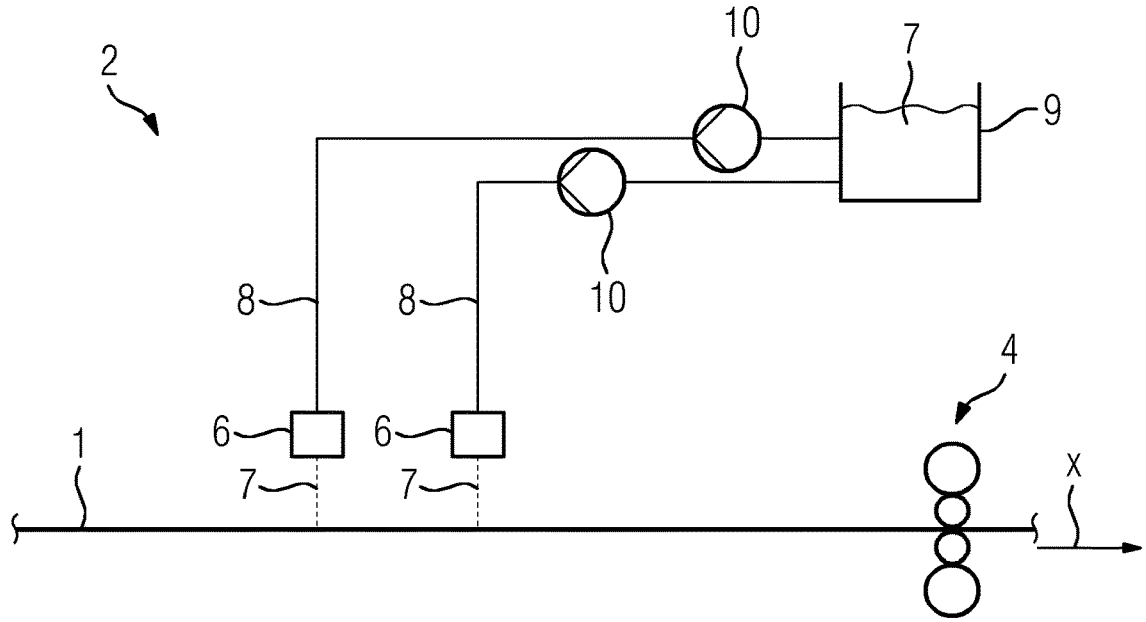
FIG. 2 shows a cooling section arranged upstream of a rolling train.

Alternatively, the cooling section 2 could be arranged upstream of the rolling train in accordance with the illustration in FIG. 2. FIG. 2 likewise illustrates just one rolling stand 4 of the rolling train, namely the first rolling stand 4 of the rolling train. Often, however—just as in the embodiment shown in FIG. 1—the rolling train has a plurality of rolling stands 3, through which the hot-rolled product 1 passes sequentially in succession. In the case of the embodiment shown in FIG. 2, the hot-rolled product 1 is rolled in the first rolling stand 4 of the rolling train immediately after exiting from the cooling section 2. A time interval between cooling in the cooling section 2 and rolling in the first rolling stand 4 of the rolling train is in the region of a few minutes. However, it may also be just a few seconds.

Figure 3:
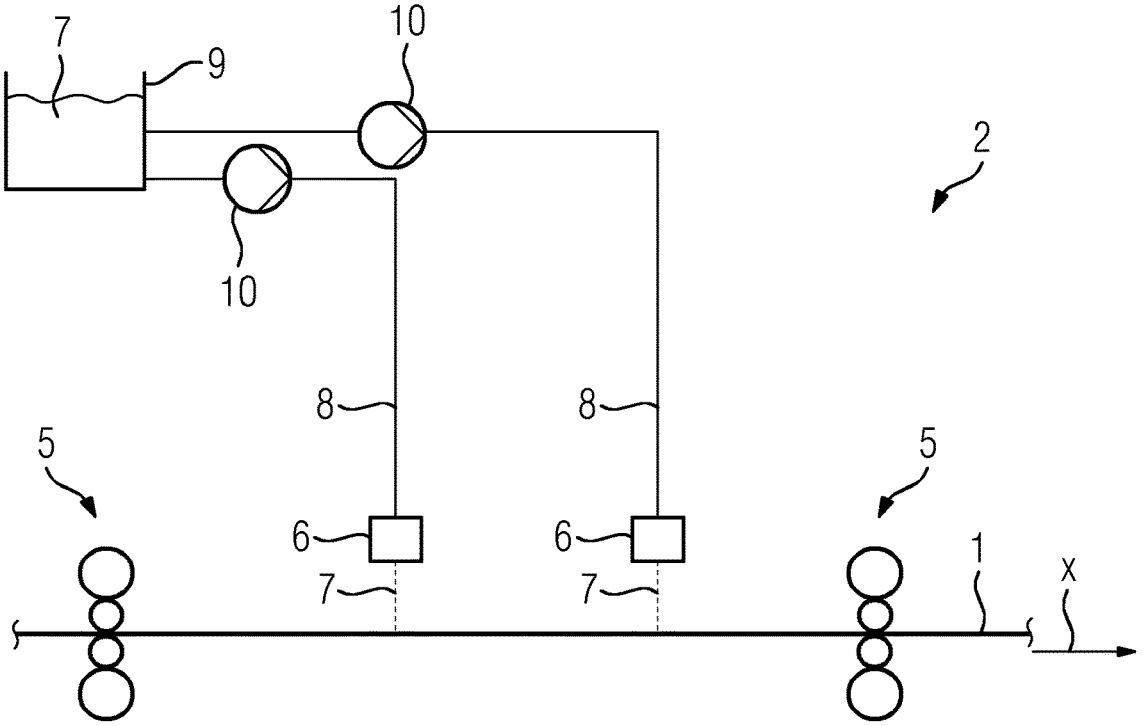
FIG. 3 shows a cooling section arranged within a rolling train.

Alternatively, the cooling section 2 could be arranged within the rolling train in accordance with the illustration in FIG. 3. FIG. 3 illustrates two rolling stands 5 of the rolling train. In this case, cooling of the rolled product 1—to be more precise: a segment of the rolled product 1—in the cooling section 2 takes place between the rolls in the two rolling stands 5 of the rolling train. A time interval between cooling in the cooling section 2 and rolling in the two successive rolling stands 5 of the rolling train is in the region of a few seconds. According to the illustration in FIG. 3, the cooling section 2 is arranged between two successive rolling stands 5 of the rolling train. However, it could also extend over a larger range, and therefore the cooling section 2 is subdivided into a corresponding number of segments by at least one further rolling stand (not illustrated in FIG. 3).

The rolled product 1 is made of metal. The rolled product 1 can be made of steel or aluminum, for example. Other metals are also possible. In the case of steel, a temperature of the rolled product 1 ahead of the cooling section 2 is in general between 750° C. and 1200° C. In the cooling section 2, cooling to a lower temperature is performed. In individual cases, it is possible for the lower temperature to be only slightly below the temperature ahead of the cooling section 2. Particularly in the case where the cooling section 2 is arranged downstream of the rolling train, however, the rolled product 1 is generally cooled to a significantly lower temperature, e.g. to a temperature of between 200° C. and 700° C.

The hot-rolled product 1 is fed to the cooling section 2 in a horizontal transport direction x. Within the cooling section 2, the transport direction x of the hot-rolled product 1 does not change. Thus, transport is also horizontal within the cooling section 2. After leaving the cooling section 2, the rolled product 1 can either retain or change transport direction. If the hot-rolled product 1 is a strip, it may be deflected obliquely downward, for example, in order to feed it to a coiler. If the hot-rolled product 1 is a plate, it usually retains the transport direction x. Any roller table required for the transportation of the hot-rolled product 1 is not included in the FIGURES.

The cooling section 2 has a number of application devices 6. By means of the application devices 6, a coolant 7 is applied to the rolled product 1. The coolant 7 is water. Additives may optionally be added in small quantities to the water (a maximum of 1% to 2%). In all cases, however, the coolant 7 is a water-based liquid coolant.

At the minimum, there is a single application device 6. In many cases, however, there is a plurality of application devices 6. The application devices can be arranged in series in accordance with the illustration in FIG. 1, for example. In this case, the application devices 6 apply their respective proportion of the coolant 7 sequentially in succession to the rolled product 1. In this context, the term "sequentially in succession" relates to a particular segment of the rolled product 1 since this segment passes sequentially in succession through regions in which the individual application devices 6 apply their respective proportion of the coolant 7 to the corresponding segment of the rolled product 1. The number of application devices 6 is often in the two-figure range, sometimes even in the upper two-figure range. A sequential arrangement in succession is generally implemented particularly when the cooling section 2 is arranged downstream of the rolling train. However, it can also be present in other scenarios.

The application devices 6 are connected to a reservoir 9 of the coolant 7 via a respective supply line 8. In the present case, the reservoir 9 is the same for all the application devices 6. However, it would also be possible for there to be a plurality of mutually independent reservoirs 9. A respective pump 10 is arranged in each supply line 8. In principle, the pumps 10 can be arranged at any points within the supply lines 8. In practice, however, it is advantageous if the pumps 10 are arranged as close as possible to the reservoir 9.

Figure 4:
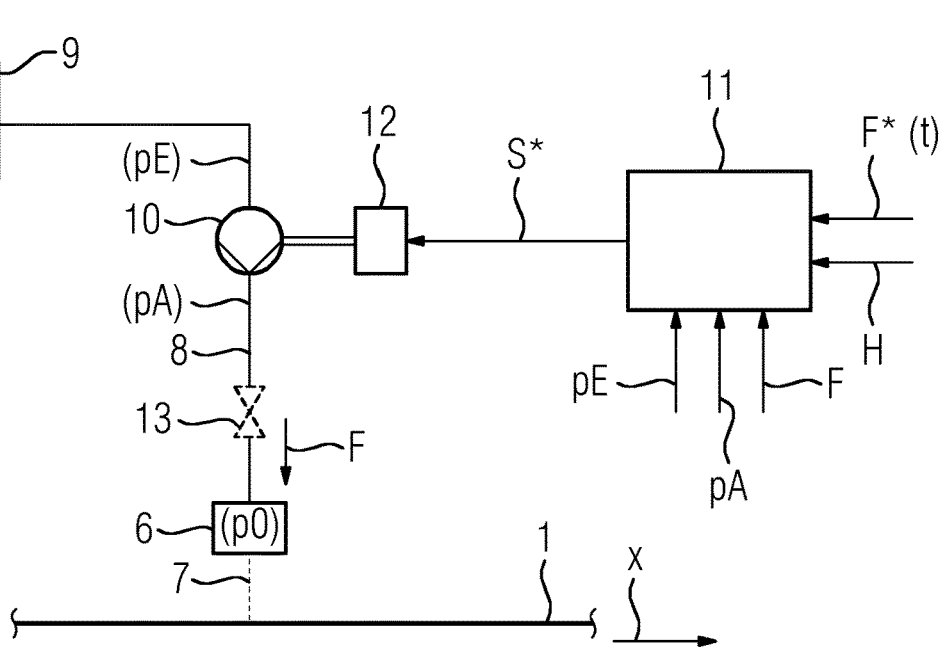
FIG. 4 shows a single application device.

The operation of one of the application devices 6 is explained in greater detail below—as a representative example of all the application devices 6—in conjunction with FIG. 4. In principle, the other application devices 6 are operated in the same way. However, the respective mode of operation for each application device 6 can be determined individually. It is therefore possible but not necessary to operate the application devices 6 in the same way.

The application device 6 is supplied with an actual flow F of the coolant 7 via the supply line 8 and the pump 10 from the reservoir 9. The actual flow F is applied to the hot-rolled product 1 by means of the respective application device 6. A distance of the application device 6—e.g. of spray nozzles—from the rolled product 1 is generally between 20 cm and 200 cm.

A controller 11 of the cooling section 2 knows a corresponding target flow F* which is to be applied to the hot-rolled product 1 by means of the application device 6. In general, the target flow F* is not constant but is variable over time, i.e. is a function of time t. On the basis of the target flow F* of the coolant 7, the controller 11 dynamically determines a target control state S* for the pump 10. It controls the pump 10 accordingly. As a result, the pump 10 subjects the coolant 7 to an outlet-side pressure pA on the outlet side of the pump 10. The outlet-side pressure pA varies in accordance with the target control state S*. However, it is below 10 bar in every operating state. Usually, the maximum is in fact 6 bar. In every operating state, however, the actual flow F delivered by the pump 10 is approximated as far as possible to the target flow F* at any time.

The target control state S* can also be readily determined. This will be explained below by means of a simple example.

Let it be assumed that the pump 10 is arranged in the immediate vicinity of the reservoir 9. The supply line 8 has a length 1 and a cross section A. The pressure on the inlet side of the pump 10 is denoted by pE below. The pressure in the application device 6 is denoted by p0.

The following relation then applies initially $$F = FN \cdot \sqrt{\frac{p0}{pN}} \tag{1}$$

FN is a nominal flow that flows out of the application device 6 when the coolant 7 in the application device has a nominal pressure pN. The nominal flow FN and the nominal pressure pN are defined and determined by the design of the application device 6. They can be determined by one-time measurement of the flow obtained at—in principle an arbitrarily defined—pressure, for example.

Furthermore, the following relation applies to the actual flow F $$\dot{F} = \frac{A}{\rho \cdot l}(pA - p0 - l \cdot r \cdot F^2) \tag{2}$$

where ρ=density of the coolant 7 and r=resistance coefficient for the flow resistance of the coolant 7 in the supply line 8.

If equation (1) is solved for the pressure p0 and substituted in equation (2), the following equation (3) is obtained:

$$\dot{F} = \frac{A}{\rho \cdot l} \cdot \left(pA - \frac{pN}{FN^2} \cdot F^2 - l \cdot r \cdot F^2\right) \tag{3}$$

Equation (3) is then solved for pA:

$$pA = \left(\frac{pN}{FN^2} + l \cdot r\right) \cdot F^2 + \frac{\rho l}{A} \cdot \dot{F} \tag{4}$$

The actual flow F is readily obtained. For example, it can be measured. The desired time derivative of the actual flow F is obtained directly from the difference between the target flow F* and the actual flow F. The time derivative of the actual flow F may optionally be limited in order to keep the outlet-side pressure pA within permissible limits.

Thus, the required outlet-side pressure pA can be readily determined. Using the desired outlet-side pressure pA and the inlet-side pressure pE, however, it is possible, in accordance with the characteristic f of the pump 10, which is readily known, to determine the associated speed n:

$$n = f(pA - pE, F) \tag{5}$$

Furthermore, the actual flow F, if not detected by measurement, can be readily determined from the relation $$F = F0 + \int_o^t \dot{F}(\tau)d\tau \tag{6}$$

where F0 is a suitably chosen constant.

Furthermore, the actual flow F is available at all times to the controller 11—either through detection by measurement or through determination by calculation in accordance with equation (6). This is necessary in order to be able to update a calculated thermodynamic energy state H of the rolled product 1. Further details of this will be given below. As the dead time of the application device 6 there is in addition only the generally very short time that the coolant 7 requires to strike the rolled product 1—calculated from emergence from the application device 6.

Open-loop or closed-loop control may be performed, depending on requirements. In the case of closed-loop control, the actual flow F is detected on the inlet side or the outlet side of the pump 10 and supplied to the controller 11. If no such detection takes place, the actual flow F is subject to open-loop control.

In order to be able to control the pump 10 accordingly, it must be possible to operate the pump 10—to be more precise: the drive 12 thereof—with a variable speed. For this purpose, the drive 12 of the pump 10 can be controlled by a frequency converter, for example. Such control systems are a matter of common knowledge to those skilled in the art and therefore do not need to be explained in more detail. The pump 10 can preferably be operated in a control range between 0 and a maximum speed. A sealing system for the pump 10 should also be designed for low speeds. However, this is readily possible. Corresponding pumps 10 are known to those skilled in the art.

To adjust the actual flow F to the target flow F*, therefore, the pump 10 is controlled in a correspondingly dynamic manner, and the actual flow F is approximated as far as possible to the target flow F*. On the other hand—in contrast to the prior art—there is no control of a valve arranged in the supply line 8. On the contrary, if such a valve is present, it remains continuously in the fully open state.

In the context of the operating method according to the invention, it is thus possible for there to be no shutoff device arranged between the pump 10 and the application device 6. Alternatively, in accordance with the illustration in FIG. 4, it is possible for such a shutoff device 13 to be arranged between the pump 10 and the application device 6. In FIG. 4, the shutoff device 13 is depicted only in dashed lines because, although it may be present, it does not have to be present. If the shutoff device 13 is present, the shutoff device 13 can be operated in two different ways.

Figure 5:
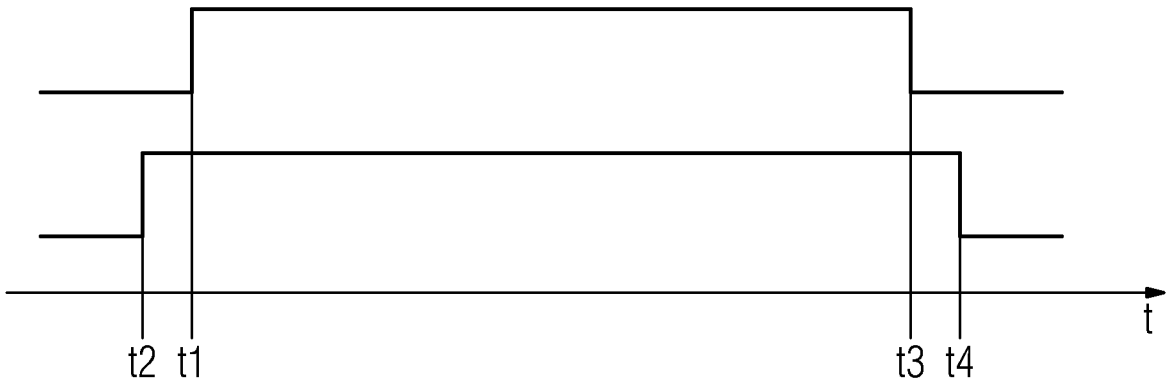
FIG. 5 shows a timing diagram.

On the one hand, it is possible for the shutoff device 13 to be held continuously in the fully open state during the transport of the rolled product 1 through the cooling section 2. In FIG. 5, this is illustrated by the rolled product 1 entering the cooling section 2 at a point in time t1. Even before point in time t1, however, the shutoff device 13 is opened at a point in time t2. Similarly, the rolled product 1 runs out of the cooling section 2 at a point in time t3. Only after point in time t3 is the shutoff device 13 closed again at a point in time t4. Between points in time t2 and t4, the shutoff device 13 remains continuously in the fully open state.

Figure 6:
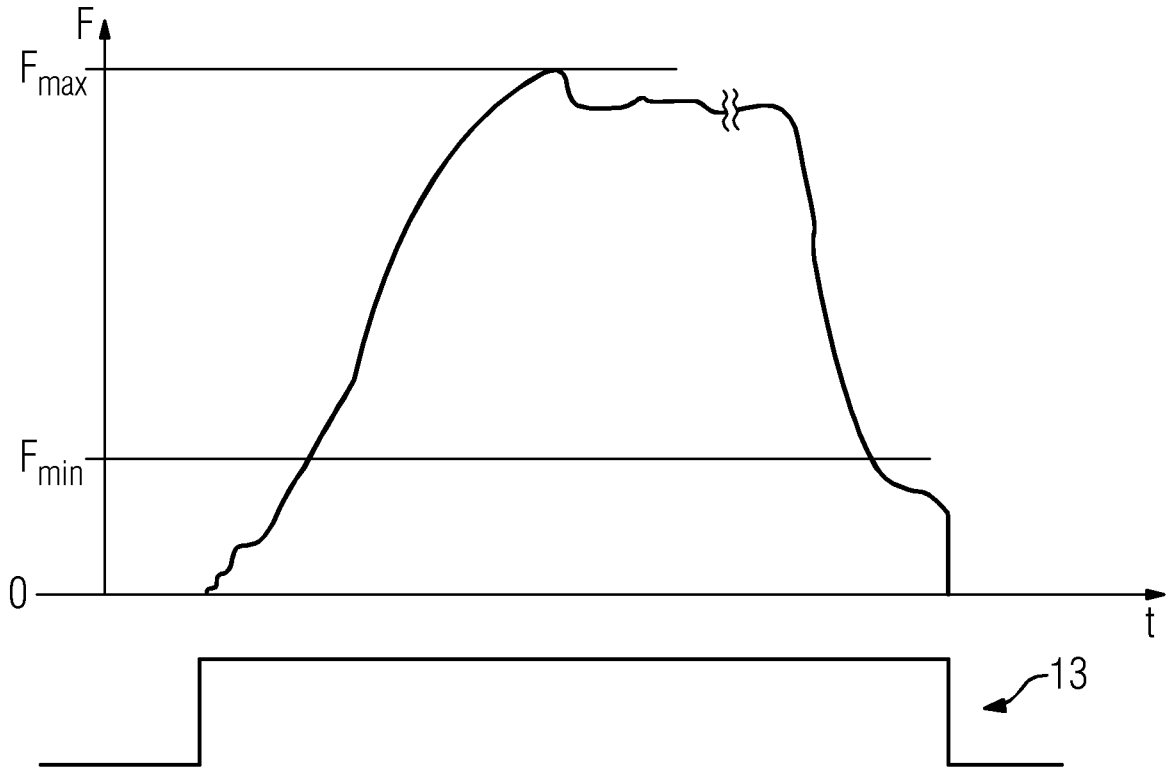
FIG. 6 shows a diagram.

On the other hand, it is possible for the shutoff device 13 to be actuated only when a speed of the pump 10 is below a minimum speed nmin. This is explained in greater detail below in conjunction with FIG. 6. According to FIG. 6, the speed of the pump 10 can vary between 0 and a rated speed nmax. If and as long as the speed n remains below a minimum speed nmin, the shutoff device 13 can be actuated. This applies both to opening and to closing of the shutoff device 13. If and as soon as the speed n reaches or exceeds the minimum speed nmin, however, the shutoff device 13 remains open. It is therefore necessary, in particular, in this case initially to open the shutoff device 13 at a very low speed n. This is followed by the operation of the application device 6, during which only the pump 10 is correspondingly controlled in order to adjust the actual flow F. Only when the speed n falls below the minimum speed nmin again is it possible and permissible for the shutoff device 13 to be actuated again.

Figure 7:
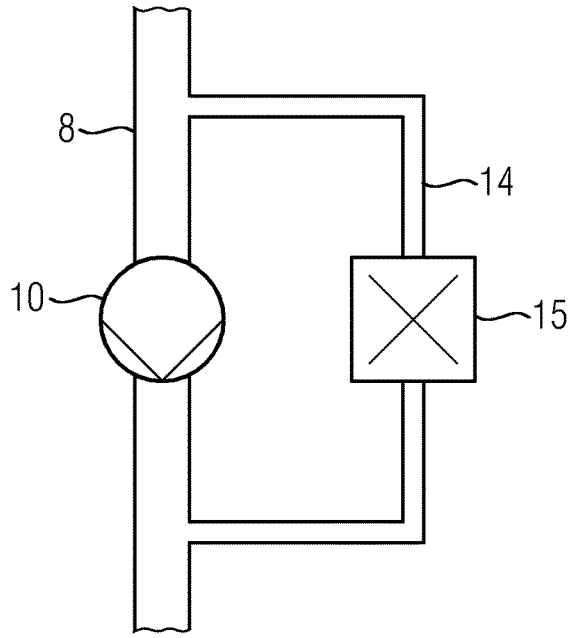
FIG. 7 shows a segment of a supply line with a pump.

Depending on the type of pump 10, the pump 10, when operated, must always deliver a minimum flow. The minimum flow may be greater than the target flow F*. In order to be able to accommodate this case too, it is possible, in accordance with the illustration in FIG. 7, to assign a return line 14 in parallel to the pump 10. However, the return line 14 has a smaller cross section than the supply line 8. In particular, this is because the return line 14 has only to be designed to be able to carry the minimum flow. The supply line 8, on the other hand, must be designed to be able to carry a maximum flow, wherein the maximum flow is greater—generally considerably greater—than the minimum flow. The embodiment according to FIG. 7 makes it possible to use, as pump 10, a pump in which, owing to the design, a certain minimum flow of coolant 7 has to be maintained at all times. However, the minimum flow is considerably less than the maximum possible flow of coolant 7. If, in the case of the embodiment shown in FIG. 7, a quantity of coolant 7 that is less than the minimum flow is to be applied to the rolled product 1, all that is required is to correspondingly open a valve 15 arranged in the return line 14 (bypass mode). Moreover, the shutoff device 13 must be present in this case. In this case, the shutoff device 13 and the valve 15 must be designed as control valves. In this case too, however, the shutoff device 13 is only (fully or partially) closed when the actual flow F is below the minimum flow. In practice, the situation where the target flow F* assumes values below the minimum flow occurs only very seldom. Normally, therefore—i.e. when the actual flow F is above the minimum flow—the shutoff device 13 can remain fully open and the bypass valve 15 fully closed.

Figure 8:
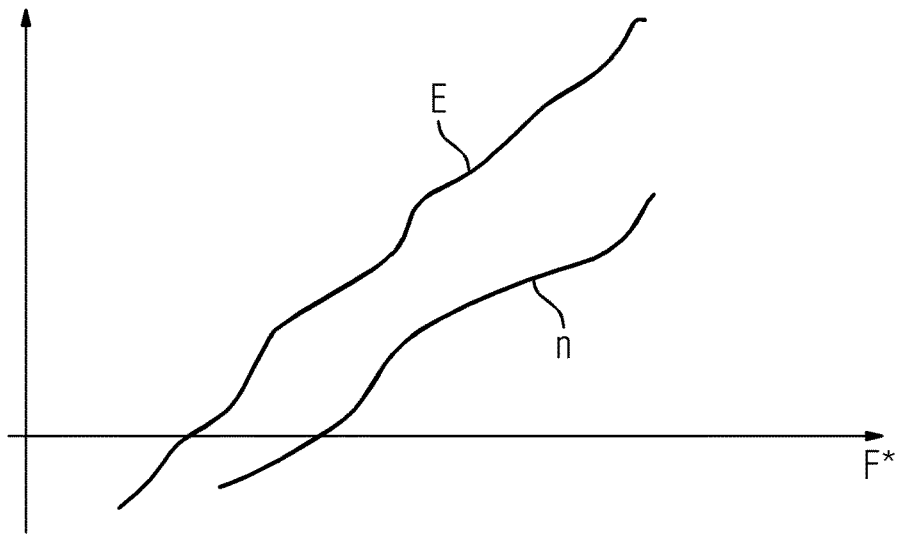
FIG. 8 shows a diagram.

According to FIG. 8, the target flow F* can vary. At higher values, the values for a speed n of the pump 10 are significant, and therefore the pump 10 actively delivers (pumps) the coolant 7. As a result, the pump 10 consumes energy E. However, if the target flow F* decreases, it may occur that, although the pump 10 continues to rotate in the same direction of rotation as at higher values, the pump 10 is operated as a generator. That is to say it outputs energy E. The energy E can be fed back into a supply network via the drive 12 of the pump 10, for example. It is even possible for the pump 10 to be operated with a reversed direction of rotation ("speed n<0"). In this case, the pump 10 continues to consume energy since it actively tries to return coolant 7.

Figure 9:
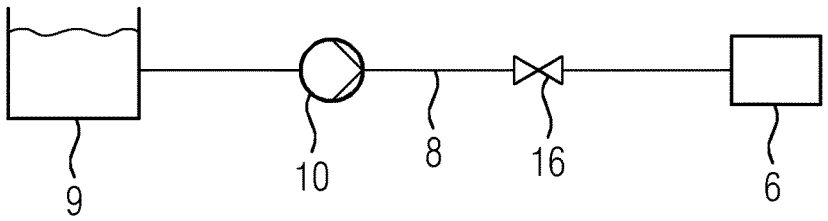
FIG. 9 shows a segment of a supply line with a pump.

If the pump 10 is operated with a reversed direction of rotation in some operating states, a check valve 16 or a swing check valve is preferably arranged between the pump 10 and the application device 6 as shown in the illustration in FIG. 9. The check valve 16 or swing check valve can operate in a purely passive way. The check valve 16 or swing check valve can be subjected to a slight spring force, for example, with the result that, although preloaded into the closed position, they open at only a very low pressure. The check valve 16 or swing check valve do not have to be actively controlled by the controller 11. In particular, the check valve 16 or swing check valve prevent the supply line 8 between the pump 10 and the application device 6 running empty when the direction of rotation is reversed. In this case, the pump 10 can be switched off after a possible closure of the shutoff device 13 as soon as the shutoff device 13 is closed, i.e. further flow of the coolant 7 is blocked. However, since the shutoff device 13 does not have to slow down the flow of coolant 7 but merely closes when the flow of coolant 7 has already been stopped or at least substantially stopped, a relatively simple embodiment of the shutoff device 13 is adequate. Furthermore, the shutoff device 13 can have low dynamic performance since dynamic adjustments are performed by the pump 10. Furthermore, a check valve 16 of this kind or a swing check valve of this kind is also required when an application device 6 arranged above the rolled product 1 is supplied via the pump 10. This is because, otherwise, the coolant 7 would flow back through the pump 10 into the reservoir 9 in the reverse direction at a speed of 0. As a result, a buffer region of the application device 6 could empty. The buffer region would then first have to be filled again if the pump 10 were switched on again. This would increase the effective response time of the application device 6 which is—of course—not desired.

If the coolant 7 is made available in an unpressurized state on the inlet side of the pump 10, the pump 10 can have conventional impellers. If, on the other hand, the coolant 7 has a feed pressure, e.g. 1 bar, the pump 10 can be designed in such a way that the coolant 7 cannot simply flow through when the pump 10 is stationary. In this case, the pump 10 must be designed in such a way that it at least largely forms a seal when stationary. Alternatively, the pump 10 can be designed in such a way that it can also be operated in reverse. Particularly in the latter case, actuation of the shutoff device 13 is expedient after the actual flow F has been reduced to 0. Particularly in cases in which the coolant 7 has a feed pressure, the modes of operation explained above in conjunction with FIG. 9 are expedient.

As already mentioned, it is possible for pure open-loop control of the pump 10 to be performed. Preferably, however, the inlet-side pressure pE of the liquid coolant 7 is detected ahead of the pump 10 and fed to the controller 11 in accordance with the illustration in FIG. 4. In this case, the controller 11 takes account of the detected inlet-side pressure pE in determining the target control state of the pump 10. In many cases, detection of the water level in the reservoir 9 is equivalent to pressure detection. As is likewise illustrated in FIG. 4, it is furthermore possible, if required, to additionally detect the outlet-side pressure pA after the pump 10 as well and to feed it to the controller 11. In this case, the controller 11 additionally also takes account of the detected outlet-side pressure pA in determining the target control state of the pump 10.

Figure 10:
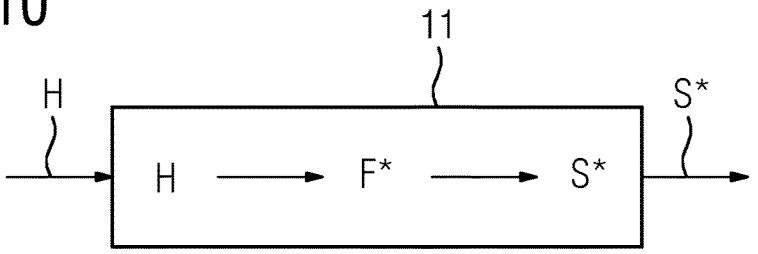
FIG. 10 shows the mode of operation of a controller.

It is possible for the target flow F* to be stipulated to the controller 11 directly and immediately. However, the thermodynamic energy state H of the rolled product 1 is preferably known to the controller 11 immediately before it reaches the application device 6. The thermodynamic energy state H can be, in particular, the enthalpy or temperature of a respective segment of the rolled product 1. In this case, in accordance with the illustration in FIG. 10, the controller 11 first of all determines the target flow F* as a function of the thermodynamic energy state H and then uses the target flow F* to determine the associated target control state S*. In particular, it is possible to stipulate to the controller 11 a local or time-based target characteristic of the thermodynamic energy state H that should be maintained if possible. The controller 11 can therefore determine what thermodynamic energy state H should pertain immediately after the application device 6. By comparison with the actual thermodynamic energy state H immediately ahead of the application device 6, the controller 11 can therefore determine what quantity of coolant 7 must be applied to the corresponding segment of the rolled product 1 to ensure that the actual thermodynamic energy state H immediately after the application device 6 corresponds as well as possible to the desired target state. The required quantity of coolant 7, in combination with the time that the corresponding segment of the rolled product 1 requires to run through the application device 6, then defines the target flow F*.

All the procedures explained above in conjunction with one of the application devices 6 and the associated components thereof can also be carried out for the other application devices 6 in a fully analogous way. As already explained, the procedure mentioned is furthermore carried out for each segment of the rolled product 1.

The thermodynamic energy state H of the corresponding segment of the rolled product 1 varies from application device 6 to application device 6. In particular, it is modified by each of the application devices 6. The thermodynamic energy state H for the application device 6 which applies its share of coolant 7 first to the rolled product 1 can be stipulated as such to the controller 11. It is possible, for example, in accordance with the illustration in FIG. 1 to arrange on the inlet side of the cooling section 2 a temperature measurement location 17 by means of which the respective temperature T for the individual segments of the rolled product 1 is detected. The detected temperature T is then associated with the respective segment.

Tracking is implemented for each segment during its passage through the cooling section 2. For each additional application device 6 which applies its share of coolant 7 later, it is necessary, however, to update the corresponding thermodynamic energy state H of the rolled product 1 (or of the corresponding segment of the rolled product 1). In this process, the controller 11 takes account, in particular, of the thermodynamic energy state H immediately ahead of the immediately preceding application device 6 and the quantity of coolant 7 which the immediately preceding application device 6 applies to the rolled product 1. As regards the quantity of coolant 7, the controller 11 can alternatively take account of the target flow F* or of the actual flow F of the immediately preceding application device 6. Thus, it determines the respective thermodynamic energy state H of the rolled product 1 sequentially in succession for the application devices 6. As far as is necessary, it is possible in this context for the controller 11 to set up and iteratively solve a heat conduction equation and a phase transition equation.

In many cases, the rolled product 1 is a flat rolled product, e.g. a strip or a plate. In this case, it is possible that the liquid coolant 7 is applied to the rolled product 1 from both sides by means of each individual application device 6. This procedure is often adopted in the case of a cooling section 2 which is arranged upstream of the rolling train or is arranged in the rolling train. However, it can also be adopted if the cooling section 2 is arranged downstream of the rolling train. Particularly when the cooling section 2 is arranged downstream of the rolling train, however, the liquid coolant 7 is generally applied to the rolled product 1 from only one side by means of each individual application device 6, in particular from above or from below. Of course, it is also possible in this case too to apply coolant 7 on both sides of the flat rolled product 1. In this case, however, this is performed by different application devices 6, to each of which a dedicated pump 10 is assigned, wherein the pump 10 is controlled independently of the pumps 10 of the other application devices 6.

Figure 11:
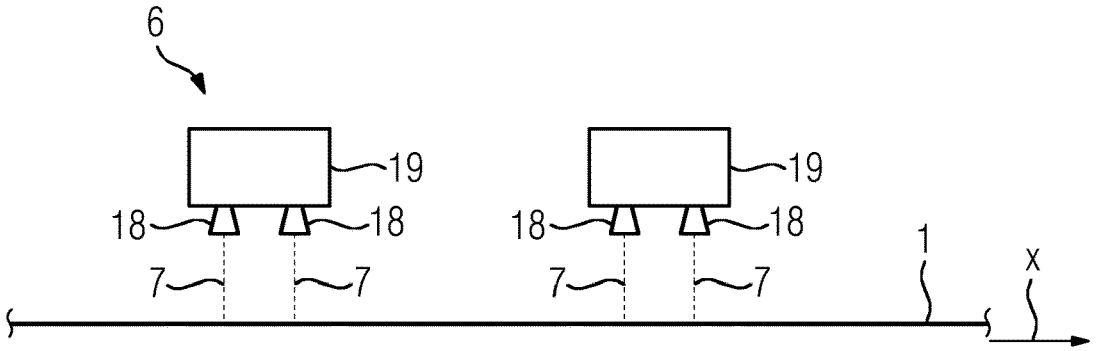
FIG. 11 shows spray bars and spray nozzles.

In extreme cases, it is possible for each of the application devices 6 to have just a single spray nozzle 18. In general, however, the application devices 6 each have a plurality of spray nozzles 18. In accordance with the illustration in FIG. 11, the spray nozzles 18 can be arranged in series when viewed in the transport direction x of the rolled product 1. The spray nozzles 18 can be arranged in series within a single spray bar 19, for example. It is also possible for a plurality of spray bars 19 arranged in series in the transport direction x to be combined into one (1) application device 6. This applies irrespective of whether the respective spray bar 19 as such has or does not have a plurality of spray nozzles 18 arranged in series. The decisive factor in each case is that each application device 6 is supplied individually with coolant 7 via its own supply line 8 and its own pump 10, wherein the pump 10 is controlled individually to adjust the respective actual flow F.

Figure 12:
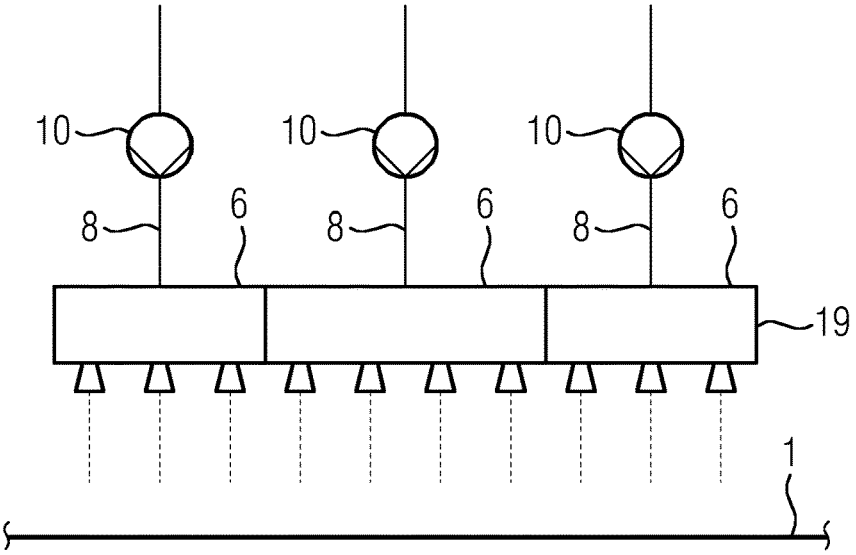
FIG. 12 shows spray bars and spray nozzles.

In accordance with the illustration in FIG. 12, the application devices 6 can furthermore often have a plurality of spray nozzles 18 which are arranged side-by-side when viewed transversely to the transport direction x of the rolled product 1. Such an embodiment can be expedient particularly in the case of a flat rolled product 1, i.e. a strip or a plate. In this case, the application devices 6 can extend over the full width of the rolled product 1. Alternatively, it is possible for the application devices 6 to extend only over part of the width. This is illustrated, purely by way of example, in the left-hand part of FIG. 12 for a spray bar 19 which—purely by way of example—is divided over its width into three application devices 6. In this case, therefore, a plurality of application devices 6 is arranged side-by-side and supplied with coolant 7 in each case via a dedicated supply line 8 and a dedicated pump 10, wherein the pumps 10 are controlled independently of one another.

The present invention has many advantages, of which a few are presented below.

Since the supply of coolant 7 is not shut off, there are no pressure shocks when the quantity of coolant 7 is abruptly reduced. Switching off is possible within a few tenths of a second (often under 0.2 s, sometimes even under 0.1 s). The same applies when increasing the required quantity of coolant 7. The actual flow F of the respective application device 6 can also be adjusted with corresponding rapidity. The drives 12 for the pumps 10 can be controlled very accurately. A normal accuracy for the speed n is in the region of 0.1%. The actual flow F for the respective application device 6 can also be adjusted with the same or similar accuracy. Taking into account the response behavior of the drives 12, it should in all probability be possible to achieve correction of the actual flow F with an accuracy of 1% in less than 0.5 s, possibly even in 0.2 s to 0.3 s.

If the coolant 7 is made available to the pumps 10 without pressure on the inlet side, particularly quick control times can be achieved. A numerical example in this regard: let it be assumed that the distance between the reservoir 9 and one of the application devices 6 and hence the length of the associated supply line 8 is an entirely conventional length of 10 m. Flow rates in the supply line 8 at maximum flow are normally about 3 m/s. If such a quantity of liquid is accelerated at 2 bar pressure, an acceleration of 20 m/s2 is obtained. With such an acceleration, the quantity of liquid can be accelerated from 0 to maximum flow with a time constant of 150 ms. If the pressure increase by the pump 10 is reduced abruptly to 0, the quantity of liquid decreases to zero again with a time constant of 150 ms since the application device 6 resists the flow initially with a back pressure of 2 bar. In this way, extremely rapid adjustment times, of the kind that cannot be achieved even approximately in the prior art, are obtained. Control is even more rapid if the pump 10 does not just reduce the pressure increase to zero but indeed actively slows down the quantity of liquid.

If the coolant 7 is supplied to the pumps 10 on the inlet side—with or without a feed pressure—via a common pipeline, the pumps 10 are coupled on the inlet side. In this case, the acceleration of the effective liquid column in this common pipeline must also be taken into account. This can have effects, in particular, if many of the pumps 10 are to be run up simultaneously or run down simultaneously. In practice, however, this state arises only infrequently, and therefore the problems that occur in this case are tolerable. Moreover, the problem can be avoided by suitable predictive control of the pumps 10.

The cooling section 2 according to the invention can be operated with a low energy consumption. For example, some of the application devices 6 can be designed as conventional bottom-mounted intensive cooling bars with a spray height of 20 m, which apply the coolant 7 to the rolled product 1 from below. In this case, the corresponding application device 6 can operate with a pump 10 that has a rated power of 25 kW, assuming a volume of coolant 7 of 360 $m^3$/h. This is because 360 $m^3$/h corresponds to 0.1 $m^3$/s. A spray height of 20 m corresponds to an operating pressure of 2 bar, i.e. 200 kPa. The mechanical power to deliver such an actual flow F is thus 0.1 $m^3$/s×200 kPa=20 kW. Even with an efficiency of just 80%, a pump power of 25 kW is thus entirely adequate. In the case of an intensive cooling system in the prior art, in contrast, the pressure employed is around twice that level. Similar figures are obtained for a top-mounted intensive cooling system.

The energy-saving is even greater if the respective application device 6 is operated with a smaller quantity of water. This is because, in the case of a conventional intensive cooling system, the reduction in the quantity of water is achieved by closing a valve. The pressure (4 bar) is maintained and the pump 10 often continues to run at the full delivery rate. In the case of the cooling section 2 according to the invention, in contrast, the speed n of the pump 10 is simply reduced. In this case, the spray height is just 5 m with half the quantity of water. Thus, only half the quantity has to be delivered with a quarter of the spray height. Hence only ⅛ of the full power is then required, that is to say somewhat over 3 kW. In the case of intensive cooling in the prior art, in contrast, it is still necessary to expend around 25 kW.

Wear on the pumps 10 and drives 12 is low. Typical service lives for pump bearings are 100,000 hours and above. Thus, the pumps 10 can be operated continuously for more than 11 years without requiring maintenance. The cooling section 2 according to the invention is therefore very failure-resistant and requires almost no maintenance in respect of the pumps 10 and the drives 12.

Another advantage obtained consists in very flexible operation of the cooling section 2. In particular, it is possible to use one and the same application device 6 and to operate it either as an intensive cooling system or as a laminar cooling system, depending on requirements. The useful control range is generally between 5% and 100% of the maximum deliverable quantity of coolant.

Admittedly, equipping the cooling section 2 with the required number of pumps 10 and associated drives 12, including the likewise associated drive control systems, does require a certain investment. However, this one-off investment is balanced out relatively quickly by the lower operating costs and increased plant availability. Moreover, costs are relativized by the consideration that considerable costs also arise for a conventional cooling section if high-grade ball valves are used. The following is an estimate in this regard: given a cooling section with 100 upper spray bars 19 and 100 lower spray bars 19, which are each controlled individually by means of a respective ball valve, costs of about €700,000 are incurred for the ball valves. For the same amount, it would also be possible to build a cooling section 2 according to the invention in which 100 upper spray bars were supplied via 50 pumps 10 and 100 lower spray bars were supplied via 50 lower pumps. Despite the smaller number of individually controllable spray bars 19, superior cooling is nevertheless obtained because the spray bars 19 can be controlled in a considerably more dynamic way.

In the case of an intensive cooling system, the costs for the cooling section 2 according to the invention are of the same order as the costs for a conventional intensive cooling system. In the case of 16 upper and lower spray bars 19, for example, a total of 32 relatively small pumps 10 and the associated drives 12, each of 25 kW, with a total electric power of 800 kW is required. In contrast, the investment for a conventional cooling section comprises 32 ball valves, 32 pneumatic servomotors, 5 booster pumps, each of 400 kW (one pump is spare), and 5 frequency converters of correspondingly large dimensions.

Although the invention has been illustrated and described more specifically in detail by means of the preferred illustrative embodiment, the invention is not restricted by the examples disclosed, and other variants can be derived therefrom by a person skilled in the art without exceeding the scope of protection of the invention.

LIST OF REFERENCE SIGNS

1 Rolled product
2 Cooling section
3 to 5 Rolling stands
6 Application devices
7 Coolant
8 Supply lines
9 Reservoir
10 Pumps
11 Controller
12 Drives
13 Shutoff device
14 Return line
15 Valve
16 Check valve
17 Temperature measurement location
18 Spray nozzles
19 Spray bars
E Energy
F Actual flow
F* Target flow
Fmax Maximum flow
Fmin Minimum flow
H Thermodynamic energy state
n Speed
nmin Minimum speed
nmax Maximum speed
p0 Pressure in the application device
pA Outlet-side pressure
pE Inlet-side pressure
S* Control state
t Time
t1 to t4 Points in time
x Transfer direction

The invention claimed is:

1. An operating method for a cooling section adapted to cool a hot-rolled product made of metal, comprising:

supplying each of a number of application devices of the cooling section with a respective actual flow of a water-based liquid coolant via a respective supply line and a respective pump;

applying the respective actual flow of the coolant to the hot-rolled product by the respective application device;

transporting the hot-rolled product within the cooling section in a horizontal transport direction during the applying operation;

determining dynamically, by a controller of the cooling section, a respective target control state for the respective pump on a basis of a respective target flow of the coolant to be applied to the hot-rolled product by the respective application device; and controlling, by the controller, the respective pump in a corresponding manner such that the respective actual flow delivered by the respective pump is approximated as far as possible to the respective target flow at any time;

wherein the cooling section is arranged one of within, upstream of, and downstream of a rolling train.

2. The operating method as claimed in claim 1, wherein arranged between the respective pump and the respective application device, there is one of:

no shutoff device;

a shutoff device held continuously in the fully open state during the transport of the rolled product through the cooling section; and the shutoff device actuated, both in the opening and in the closing direction, when a speed of the respective pump is below a minimum speed.

3. The operating method as claimed in claim 2, wherein the respective pump is connected to a return line in parallel, and in that the return line has a smaller cross section than the respective supply line.

4. The operating method as claimed in claim 1, wherein the respective pump is operated as a generator or operated with a reversed direction of rotation whenever the respective target flow falls below a respective lower limit value.

5. The operating method as claimed in claim 4, wherein one of a check valve and a swing check valve is arranged in the respective supply line between the respective pump and the respective application device.

6. The operating method as claimed in claim 1, wherein an inlet-side pressure of the liquid coolant is detected ahead of the respective pump and in that the controller takes account of the detected inlet-side pressure in determining the respective target control state of the respective pump.

7. The operating method as claimed in claim 1, wherein an outlet-side pressure of the liquid coolant is detected after the respective pump and in that the controller takes account of the detected outlet-side pressure in determining the respective target control state of the respective pump.

8. The operating method as claimed in claim 1, wherein the controller determines the respective target flow on the basis of a respective thermodynamic energy state of the rolled product pertaining immediately before the respective application device is reached.

9. The operating method as claimed in claim 1, wherein:

in that the actual flows of the coolant are applied sequentially in succession to the hot-rolled product by means of the application devices; and in that the controller determines the respective thermodynamic energy state of the rolled product from the thermodynamic energy state of the rolled product ahead of the immediately preceding application device while additionally taking into account the target flow of the coolant or the actual flow of the coolant which is applied or is to be applied to the hot-rolled product by means of the immediately preceding application device.

10. A cooling section adapted to cool a hot-rolled product made of metal, comprising:

a number of application devices, wherein each of the application devices is supplied with a respective actual flow of a water-based liquid coolant via a respective supply line of the cooling section and a respective pump of the cooling section; and a controller adapted to dynamically determine a respective target control state for the respective pump on the basis of a respective target flow of the coolant to be applied to the hot-rolled product by the respective application device, the controller further adapted to control the respective pump in a corresponding manner such that the respective actual flow delivered by the respective pump is approximated as far as possible to the respective target flow at any time;

wherein the respective actual flow of the coolant is applied to the hot-rolled product by the respective application device;

wherein the hot-rolled product is configured to be transported in the cooling section in a horizontal transport direction during the application of the coolant; and wherein the cooling section is arranged one of within, upstream of, and downstream of a rolling train.

11. The cooling section as claimed in claim 10, wherein, arranged between the respective pump and the respective application device, there is one of:

no shutoff device;

a shutoff device configured to be held continuously in the fully open state by the controller during the transport of the rolled product through the cooling section; and the shutoff device configured to be actuated by the controller, both in the opening and in the closing direction, when a speed of the respective pump is below a minimum speed.

12. The cooling section as claimed in claim 11, wherein that the respective pump is connected to a return line in parallel, and in that the return line has a smaller cross section than the respective supply line.

13. The cooling section as claimed in claim 10, wherein the respective pump is configured to be controlled in such a way by the controller that it is configured to be operated as a generator or operated with a reversed direction of rotation whenever the respective target flow falls below a respective lower limit value.

14. The cooling section as claimed in claim 12, wherein a check valve or a swing check valve is arranged in the respective supply line between the respective pump and the respective application device.

15. The cooling section as claimed in claim 10, wherein the controller takes account of a detected inlet-side pressure in determining the respective target control state of the respective pump.

16. The cooling section as claimed in claim 10, wherein the controller takes account of a detected outlet-side pressure in determining the respective target control state of the respective pump.

* * * * *